United States Patent [19]

Goldstein et al.

[11] Patent Number: 5,072,647

[45] Date of Patent: Dec. 17, 1991

[54] HIGH-PRESSURE HAVING PLASMA FLOW TRANSVERSE TO PLASMA DISCHARGE PARTICULARLY FOR PROJECTILE ACCELERATION

[75] Inventors: Yeshayahu S. A. Goldstein, Gaithersburg; Derek A. Tidman, Silver Spring, both of Md.; Dennis W. Massey, Manassas, Va.; Joseph R. Greig, Greenbelt, Md.

[73] Assignee: GT-Devices, Alexandria, Va.

[21] Appl. No.: 308,581

[22] Filed: Feb. 10, 1989

[51] Int. Cl.[5] ..... E41B 6/00

[52] U.S. Cl. ..... 89/8; 102/202.8; 102/440; 313/231.41

[58] Field of Search ..... 42/84; 89/1.705, 1.814, 89/7, 8, 28.05, 135; 102/202, 202.5, 202.7, 202.8, 202.9, 372, 373, 433, 434, 437, 440, 472, 231.41, 231.01; 313/231.41, 231.01

[56] References Cited

U.S. PATENT DOCUMENTS

| | | | |
|---|---|---|---|
| 180,840 | 8/1876 | Bull | 102/430 |
| 319,628 | 6/1885 | Russell | 102/472 |
| 803,131 | 10/1905 | DuPont | 102/202.5 |
| 1,263,763 | 4/1918 | Hasting | 89/28.05 |
| 1,358,296 | 11/1920 | Csanyi | 89/7 |
| 1,487,214 | 3/1924 | Dezendorf | 89/1.1 |
| 1,661,091 | 2/1928 | Riabouchinski | 89/8 |
| 2,405,414 | 8/1946 | Eksergian | 89/1.705 |
| 2,741,160 | 4/1956 | Musser | 89/1.705 |
| 2,767,657 | 10/1956 | Burke | 102/373 |
| 2,804,804 | 9/1957 | Cumming | 89/7 |
| 2,995,987 | 8/1961 | Fitzpatrick | 89/7 |
| 3,357,186 | 12/1967 | Multer | 60/219 |
| 3,376,459 | 4/1968 | Narbus et al. | 313/231.41 |
| 3,945,899 | 3/1976 | Nikaido et al. | 204/181 |
| 3,985,866 | 10/1976 | Oda et al. | 423/657 |
| 4,034,497 | 7/1977 | Yanda | 42/1.08 |
| 4,590,842 | 5/1986 | Goldstein et al. | 89/8 |
| 4,640,180 | 2/1987 | Rose | 89/8 |
| 4,670,662 | 6/1987 | Goldstein et al. | 307/106 |
| 4,711,154 | 12/1987 | Chryssomallis et al. | 89/7 |
| 4,715,261 | 12/1987 | Goldstein et al. | 89/8 |
| 4,846,069 | 7/1989 | Tasson et al. | 102/434 |
| 4,895,062 | 1/1990 | Chryssomallis et al. | 89/7 |

FOREIGN PATENT DOCUMENTS

| | | | |
|---|---|---|---|
| 2201694 | 7/1973 | Fed. Rep. of Germany | 89/14.05 |
| 862334 | 3/1941 | France | 89/8 |

OTHER PUBLICATIONS

Chace et al., *Exploding Wires*, vol. 3, New York: 1964, p. 339-351.

Kaye, Seymour M., Encyclopedia of Explosives and Related Items, "Plasma", 1978, pp. 307-310.

Rheinmetal, Handbook on Weaponry, 1982, pp. 9-11, 19-21.

*Primary Examiner*—Stephen C. Bentley

*Attorney, Agent, or Firm*—Lowe, Price, LeBlanc & Becker

[57] ABSTRACT

A projectile is accelerated through a gun barrel in response to high pressure gas applied to the rear of the projectile in response to a high pressure plasma discharge. Plasma from the discharge flows transversely of the discharge into a chamber through multiple openings in a passage wall that confines the discharge. The high pressure, high temperature plasma flowing into the chamber causes an exothermic reaction of water and metal particles in a slurry in the chamber to produce high pressure hydrogen gas that flows longitudinally of the discharge against the rear of the projectile. To maintain the pressure of hydrogen gas acting against the projectile relatively constant as the projectile is accelerated down the barrel, electric power applied to the discharge increases substantially linearly as a function of time.

86 Claims, 5 Drawing Sheets

HIGH-PRESSURE HAVING PLASMA FLOW TRANSVERSE TO PLASMA DISCHARGE PARTICULARLY FOR PROJECTILE ACCELERATION

FIELD OF THE INVENTION

The present invention relates generally to high pressure sources particularly adapted to be used in electrothermal guns and, more particularly, to a high pressure source wherein plasma from an electric discharge flows transversely of the discharge through a wall of a structure including a passage in which the discharge is formed.

BACKGROUND ART

In commonly assigned U.S. Pat. Nos. 4,590,842 and 4,715,261 and in the co-pending, commonly assigned U.S. Pat. application Ser. No. 809,071 filed Dec. 13, 1985, now abandoned in favor of U.S. application Ser. No. 07/252,551, filed Oct. 3, 1988 (now U.S. Pat. No. 4,974,487) and Ser. No. 061,214, filed June 12, 1987, there are disclosed projectile accelerators wherein a capillary discharge is formed between a pair of spaced electrodes at opposite ends of a tube having a capillary passage. The term "capillary passage and/or discharge" as used in the prior art patents, applications and herein, refers to a passage and/or discharge having a length to diameter ratio of at least 10:1. In all of these prior art devices, the capillary discharge is formed in a dielectric tube, preferably formed of a hydrocarbon, particularly polyethylene. In response to a discharge voltage between the electrodes, a relatively high impedance plasma, that is, an impedance matched to a high voltage power supply for the discharge, forms in the capillary passage. The plasma in the passage fills the passage, causing material to be ablated from the dielectric wall in response to the high temperature of the plasma that is convectively transferred to the wall, as well as in response to radiation of the plasma being incident on the wall. The dielectric wall tube is preferably a hydrocarbon because hydrogen atoms become dissociated from the carbon atoms, to produce copious amounts of high pressure, high temperature hydrogen. Hydrogen is a preferred material for the high pressure source because of its high sound speed associated with the low atomic weight thereof.

In the prior art devices, high temperature, high pressure plasma gas flows longitudinally of the discharge and of the passage through an aperture defined by an electrode at one end of the capillary passage. The gas flowing longitudinally from the capillary passage through the aperture produces a high pressure, high velocity gas that accelerates a projectile to a high velocity.

In U.S. Pat. application Ser. No. 809,071, the high pressure, high temperature plasma is incident on a fluid such as water. The water interacts with the plasma to cool the plasma and prevent ablation from a barrel bore wall through which the projectile is accelerated by the high pressure gas resulting from the interaction of the plasma with the liquid. In U.S. Pat. application Ser. No. 061,214, hydrogen is produced by interacting the plasma flowing through the orifice with a metal hydride and some other material to produce high pressure hydrogen. The plasma is also cooled since it interacts with a cooling agent, e.g. water, while an exothermal reaction is occurring.

In U.S. Pat. application Ser. No. 809,071, the pressure acting on the rear of the projectile is maintained constant while the projectile is accelerated through the barrel bore even though the volume of the barrel bore between the plasma source orifice and the projectile increases. This result is attained by increasing the electric power applied to the capillary discharge in a substantially linear manner as a function of time.

The prior art devices wherein plasma flows longitudinally out of an aperture at the end of a capillary passage have performed capably to accelerate projectiles to very high speeds, e.g., approximately 5 km per second for small projectiles and in excess of 2 km per second for relatively large, metal projectiles that have pierced one inch armor with holes about two inches in diameter. However, the prior art structures are relatively long because of the need for a fuel container, e.g., containing the metal hydride, to be downstream of the plasma source outlet or orifice. Because the plasma flows longitudinally through the orifice, the fuel must be in a container that extends longitudinally from the plasma source as disclosed in co-pending application Ser. No. 809,071.

The efficiency of the prior art device has been limited to approximately 38% because the plasma power flux must flow through a choke throat at the end of the capillary passage. It is most desirable for only very low atomic weight materials having high sound speeds, such as hydrogen, to move in the capillary passage. There are also substantial limitations on the amount of power that can longitudinally flow out of an opening at the end of a capillary passage. Such power limit is equal to $$\frac{\gamma}{\gamma - 1}(PvA)$$

where $\gamma$ is the ratio of the specific heat of the gas at constant pressure to the specific heat of the gas at constant volume, typically equal to 1.25 for the plasma flowing through the orifice, P is the plasma pressure at the orifice, i.e., throat, of the capillary discharge, v is velocity of the plasma flowing through the throat and A is the throat area.

The maximum plasma pressure, typically equal to about 7 kilobars, is limited by the materials forming the plasma throat. The plasma velocity at the throat is limited by the plasma temperature to a value of approximately 10 km per second; the maximum area of the plasma throat is limited by the plasma electrical resistance to a value of about 1.5 $cm^2$. From these stated maximum values for PvA and a 1.25 value of $\gamma$, the typical maximum plasma power from a single prior art axial flow power source is limited to about $5 \times 10^9$ watts. To accelerate projectiles in large bore guns, where tens of gigawatts are required, multiple sources of the prior art type must be employed.

It is, accordingly, an object of the present invention to provide a new and improved method of and apparatus for providing a high pressure gas that is particularly suited to accelerate a projectile.

Another object of the present invention is to provide a new and improved electrothermal gun.

A further object of the present invention is to provide a new and improved electrothermal gun having greater efficiency than prior art electrothermal guns.

Still an additional object of the present invention is to provide a new and improved electrothermal gun having a cartridge that is relatively short in length, even though it may include a fuel source downstream of a plasma generator.

Still an additional object of the present invention is to provide an electrothermal gun that is particularly adapted for use in connection with large bore projectile acceleration.

An additional object of the present invention is to provide an electrothermal gun having multiple plasma sources arranged in a compact manner enabling facile mixture of gases from the several sources.

THE INVENTION

In accordance with the present invention, a method of and apparatus for deriving a high pressure gas particularly adapted for accelerating a projectile comprises a capillary plasma discharge source which is arranged so that high temperature, high pressure plasma gas produced in response to the plasma discharge flows transversely of the discharge into a chamber, thence to a projectile in a barrel. Because the plasma flows transversely of the discharge it is not necessary for the plasma discharge to be of the capillary type, although a capillary discharge is advantageous in certain situations, e.g., to facilitate impedance matching of the discharge to a power supply that establishes the discharge.

The chamber may include a source of fuel, such as water, or an oxidizer, such as hydrogen peroxide, or a hydrogen generator, such as a metal hydride or aluminum and water. Gas in the chamber has sufficiently high pressure that is applied to the rear of the projectile to accelerate the projectile to high speed in a barrel bore that contains the projectile and is coaxial with the chamber.

The chamber receiving the high temperature, high pressure plasma gas flowing transversely from the plasma discharger source is, in one embodiment, coaxial with a longitudinal axis of the passage and surrounds the passage. In such an arrangement, the passage axis is coincident with the longitudinal axis of the barrel and the plasma flows radially outwardly from the passage into the chamber.

In other embodiments, plural passages are located in the chamber and have longitudinal axes extending in the same direction as the chamber longitudinal axis, which coincides with the barrel axis. High temperature, high pressure plasma gas from each of the passages flows transversely of each passage axis into the chamber, both toward and away from the chamber axis.

Because the high pressure, high temperature plasma gas flows transversely of the discharge into the chamber in all embodiments, the entire length of a cartridge assembly containing the source is considerably reduced relative to the prior art arrangement wherein the high temperature, high pressure plasma flows longitudinally into a fuel containing chamber located longitudinally of the plasma discharge.

It has been found that there is considerably higher efficiency in transferring energy from an electrical power supply to the projectile with transverse flow arrangement. The multiple jets acting against a large surface area of the fuel have been found particularly advantageous for a fuel formed as a slurry of metal, particularly aluminum, and water which exothermically reacts to produce high pressure hydrogen. When a metal and water are positioned downstream of an outlet of a longitudinal plasma source, performance has not been adequate because of the small interaction area between the water, aluminum and plasma. The transverse geometry has also been found advantageous because it permits long penetrator rods on projectiles to be driven by the high pressure gases supplied by the chamber to the projectile.

It has been found that the impedance of the plasma discharge is increased to facilitate matching to the power supply by loading the passage with a slurry of the hydrogen containing liquid (preferably water) and particles of the metal (preferably aluminum). Because the slurry has a high thermal capacity it is difficult to establish the plasma discharge, a disadvantage which is overcome by providing a consumable starter wire, that extends partly between electrodes plugging the ends of the passage in a dielectric sleeve. The dielectric sleeve contains a dielectric fluid having a low thermal capacity, e.g., air, and separates the dielectric fluid and the wire from the slurry.

The above and still further objects, features and advantages of the present invention will become apparent upon consideration of the following detailed description of several specific embodiments thereof, especially when taken in conjunction with the accompanying drawings.

DESCRIPTION OF THE PREFERRED EMBODIMENT

Figure 1:
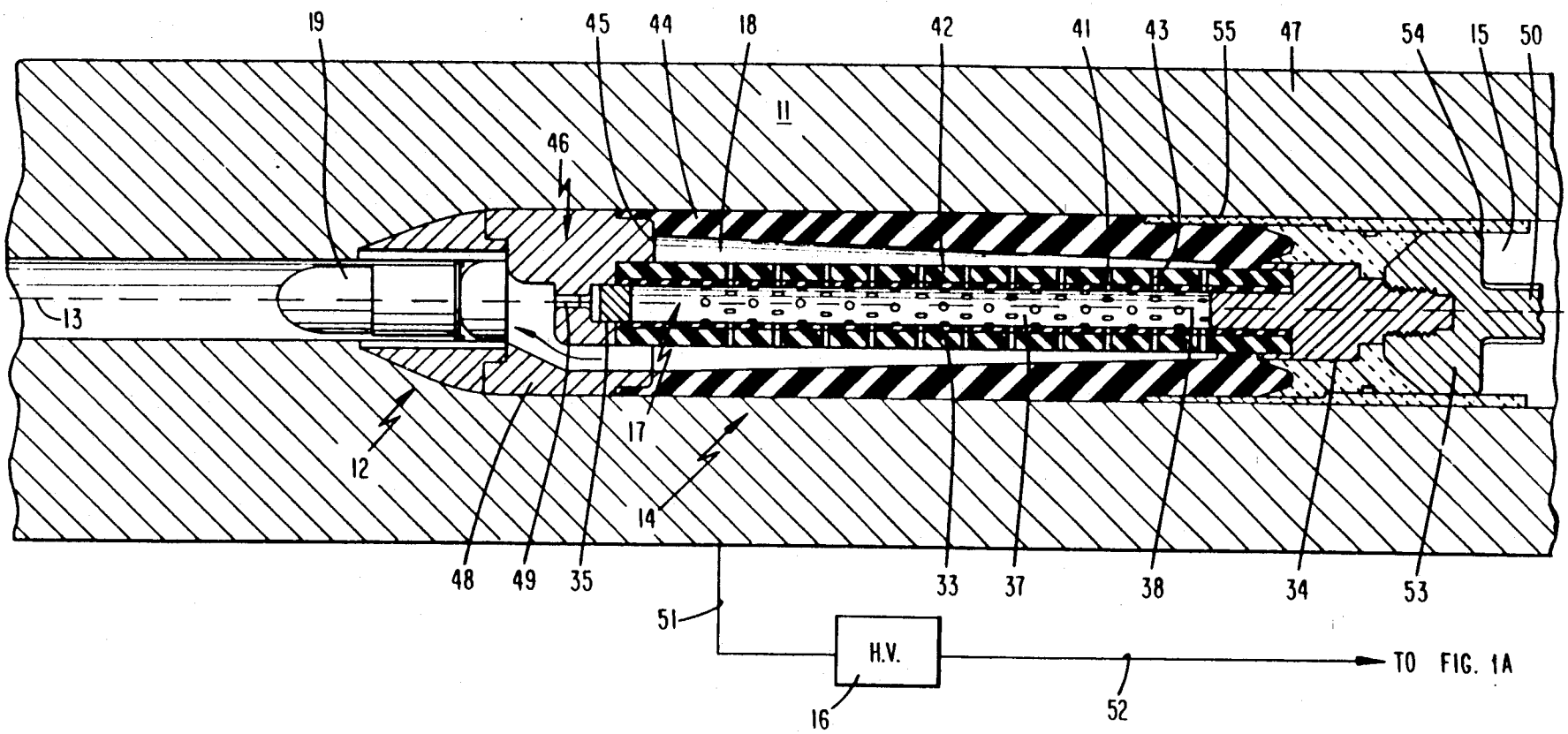
FIGS. 1 and 1A, together are a side view of a preferred embodiment of an electrothermal gun in accordance with a first embodiment of the invention wherein a capillary plasma source has a longitudinal axis coincident with a longitudinal axis of a barrel through which the projectile is accelerated.
Figure 1A:
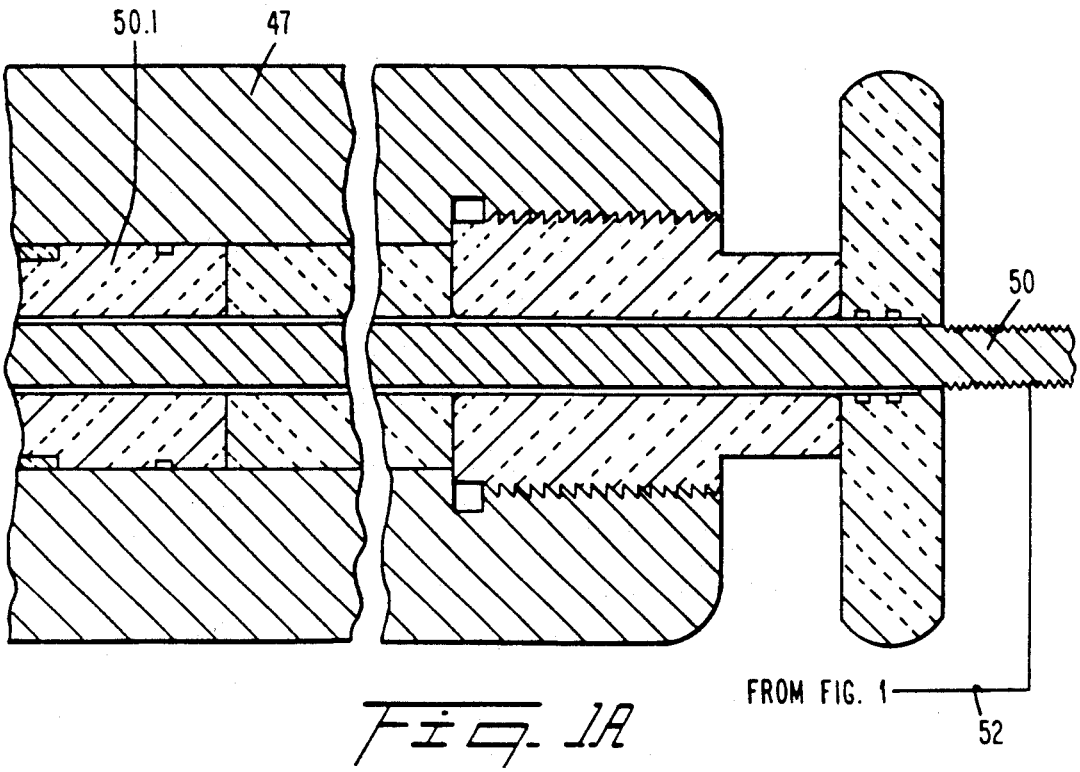

Reference is now made to FIG. 1 of the drawing wherein electrothermal gun 11 is illustrated as including barrel 12 having a longitudinal axis 13 and cartridge 14 which is loaded into the gun through breech 15. Cartridge 14 is activated by electric power supply 16 having a voltage of 15 to 50 kilovolts and a current capacity of tens to hundreds of kiloamperes. Power supply 16 may take several forms, e.g., a number of shunt capacitors and series inductors or be of the type disclosed in commonly assigned U.S. Pat. No. 4,670,662. Preferably, power supply 16 is arranged to produce a current that increases as the square root of time so that the power derived from the power supply increases linearly with time, as disclosed in the aforementioned application, U.S. Pat. application Ser. No. 809,071.

Cartridge 14 includes plasma generator 17, chamber 18 which responds to high pressure, at least about one kilobar, high temperature, at least about 3000° K, plasma gases flowing from the plasma generator, and projectile 19. Cartridge 14 is inserted through breech 15 into electrothermal gun 11 so that the cartridge longitudinal axis is coincident with longitudinal axis 13 of barrel 12.

Plasma source 17 includes dielectric capillary tube 33 (preferably fabricated of a hydrocarbon, particularly LEXAN) having a longitudinal axis coincident with axis 13 of barrel 12. Electrodes 34 and 35, plugging opposite ends of capillary passage 37 of tube 33, are connected to opposite terminals of power supply 16. Consumable, starter wire 38 (shown in FIG. 1B and not shown in FIG. 1 to simplify the drawing), preferably fabricated of aluminum, extends longitudinally of passage 37 along longitudinal axis 13. Wire 38 is mounted on electrode 34 to which it is electrically connected and extends toward electrode 35, in the manner described in U.S. Pat. No. 4,715,261. In response to the discharge voltage of source 16 being applied between electrodes 34 and 35, wire 38 ionizes to form a plasma discharge that quickly consumes the wire to establish a complete discharge between electrodes 34 and 35. While passage 37 is illustrated as a capillary, i.e., having a length to diameter ratio of at least 10:1, this is not necessary in all situations. For high voltage, low current plasma discharges the length to diameter ratio of at least 10:1 should be employed. However, for low voltage high current plasma discharges, the length to diameter ratio of passage 37 may drop to as low as 2:1.

Figure 1B:
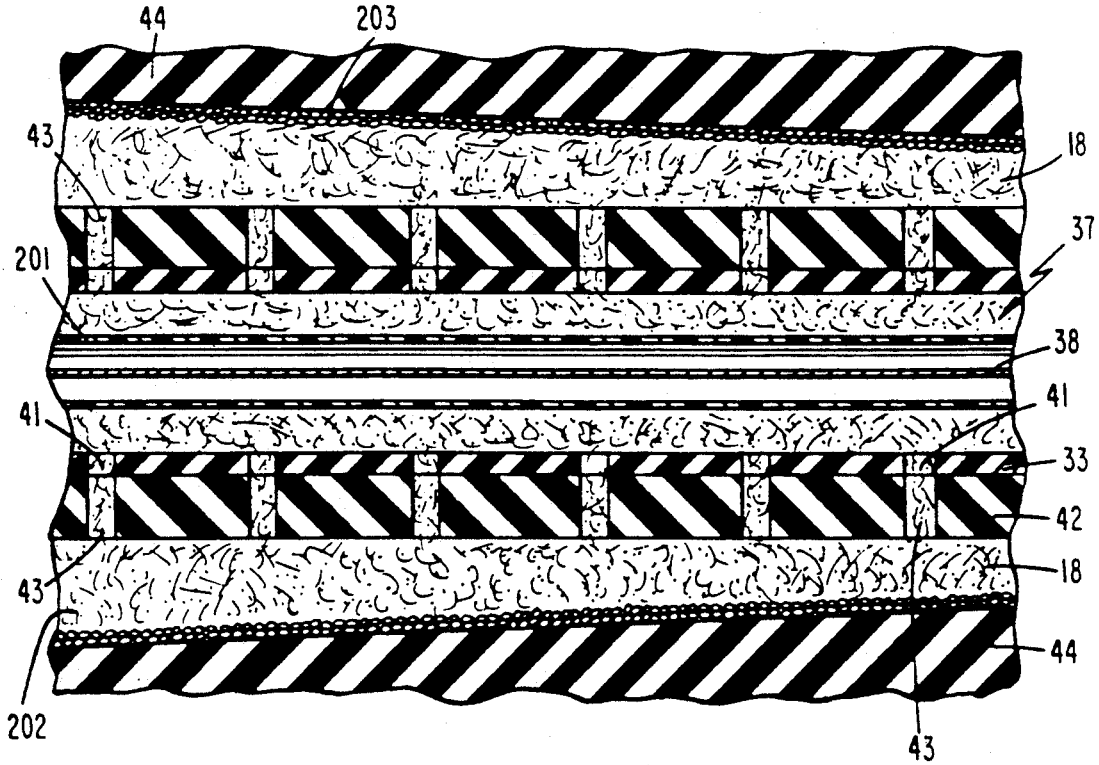
FIG. 1B is an enlarged side view of a portion of the gun illustrated in FIG. 1.

In the preferred embodiment, as illustrated in detail in FIG. 1B, wire 38 is enclosed in dielectric, straw-like sleeve 201 that extends between electrodes 34 and 35 and contains a dielectric gas, e.g., air, having a low thermal capacity relative to that of the slurry. Sleeve 201, preferably polyethylene, is surrounded by slurry 202 of aluminum particles and water. Slurry 202 extends through aligned orifices 41 and slots 43 in dielectric tube 33 and sleeve 42 and fills all of the volume of chamber 18 except the chamber portion in contact with the chamber exterior wall, as defined by the inner diameter of tube 44. The inner diameter of tube 44 is lined by polyethylene frangible sphere-like capsules 203 that are filled with air or some other gas that allows expansion of gas produced by the slurry against the wall of tube 44. The slurry in chamber 18 is confined by a diaphragm (not shown) at chamber outlet 45, or the aluminum particles and water can be bonded into a semi-solid mass with a bonding agent, particularly methyl cellulose. Sleeve 201 must separate slurry 202 in passage 37 from wire 38 because the large thermal capacity of the slurry would otherwise extinguish the plasma before the plasma reaches a sufficient temperature to convert the slurry to additional plasma.

The plasma formed initially in tube 201 very rapidly breaks through sleeve 201 and vaporizes the water-aluminum particle slurry in passage 37 to form additional plasma that very rapidly fills the passage to form a discharge channel between electrodes 34 and 35. The plasma discharge fills the entire region of passage 37, is very hot and has very high pressure, as disclosed in U.S. Pat. No. 4,590,842. Heat from high temperature plasma in passage 37 is conductively and convectively transferred to the slurry and interior wall of tube 33 by the slurry and plasma formed by the slurry. In addition, radiation from the plasma in passage 37 is transferred to the slurry and the wall of the 33, causing carbon and hydrogen to be ablated from the wall and plasma to be derived from the slurry to provide a regenerative plasma generating process.

The capillary plasma discharge in capillary passage 37 between electrodes 34 and 35 has a higher dance than the approximately 50 milliohm impedance of the prior art because of the slurry in passage 37. The high impedance discharge facilitates matching to power supply 16 and provides efficient transfer of energy from the power supply to the discharge.

The high temperature, high pressure plasma gas formed in the capillary plasma discharge between electrodes 34 and 35 in capillary passage 37 flows radially, i.e., transversely of axis 13 of passage 37 and of the longitudinal discharge between electrodes 34 and 35, through radially directed orifices 41 in tube 33. Tube 33 is surrounded by rigid dielectric sleeve 42 capable of withstanding the high pressure gases in passage 37. Sleeve 42 includes elongated, radially extending slots 43, aligned with corresponding orifices 41 in tube 33, to provide a flow path from passage 37 to chamber 18 for the hydrogen and carbon gases of the plasma. As plasma gases flow through orifices 41 and slots 43 into chamber 18, having a longitudinal axis coincident with axis 13, the regenerative plasma generating process continues in passage 37 to replenish the plasma removed from the passage with additional plasma derived by ablating hydrogen and carbon from wall 33.

Chamber 18 has an inner wall defined by the constant diameter cylindrical outer wall of sleeve 42. Chamber 18 has an outer wall that tapers outwardly from the vicinity of electrode 34 to the vicinity of electrode 35 and which is defined by the inner, tapered wall of dielectric tube 44, fabricated of a material capable of withstanding the extreme pressures developed in chamber 18: LEXAN with suitable structural supports, e.g., rovings, is an exemplary material for sleeve 42 and tube 44. The cross sectional area of chamber 18 decreases as a function of the distance of the chamber position from the initial location of projectile 19. The tapered wall geometry resulting in increasing cross sectional area of chamber 18 toward chamber outlet 45 assists in directing the high pressure gas flowing through passages 43 from capillary passage 17 against the rear of projectile 19.

The high pressure gas developed in chamber 18 flows through orifice 45 at the end of the chamber into plenum 46, located longitudinally downstream of chamber 18 and upstream of the bore of barrel 12. In plenum 46 is located metal vane structure 48 having outer edges abutting against the inner cylindrical wall of steel casing 47 of barrel 12 and an inner cylindrical wall contacting electrode 35 to provide a path for electric current via bus 51 from one terminal of supply 16 to electrode 35. Vane structure 48 includes three passages (only one of which is illustrated) for directing the flow of high pressure gas into the bore of barrel 12. The vanes of structure 48 are radially directed from axis 13 and intersect each other at or in the vicinity of axis 13. The high pressure gas flowing through plenum 46 and the passages of vane structure 48 works against the rear of projectile 19, to accelerate the projectile through the bore of barrel 12.

Steel casing 47 provides mechanical stability for the parts in cartridge 14, in particular to dielectric tube 44 so that the tube is not fractured in response to the high pressures developed against the tapered interior wall thereof. Casing 47 has a cylindrical inner diameter against which the outer, cylindrical wall of tube 44 abuts and expands in response to the high pressures developed in chamber 18.

The current path between the other terminal of high voltage source 16 and electrode 34 is via bus 52 and metal shaft 50 that extends from the breach of gun 11 to metal block 53, thence to electrode 34 longitudinally within plasma generator 14. Shaft 50 is insulated from steel casing 47 by dielectric sleeve 50.1 which surrounds the shaft. Metal block 53 has a circular outer wall abutting against the inner, cylindrical wall of dielectric sleeve 54, having an outer diameter abutting against the inner, cylindrical wall of sleeve 47. Movement of sleeve 54 is restrained because the wall portion of the sleeve closest to projectile 19 fits into gap 55, with the inner diameter of the sleeve abutting against tube 44 and the outer diameter of the sleeve abutting against casing 47.

Chamber 18 may be filled with air, a confined fluid, such as water, as disclosed in the commonly assigned, co-pending U.S. Pat. application Ser. No. 809,071, or a water-metal hydride arrangement that exothermically reacts in response to the high temperature, high pressure plasma flowing through orifices 41 and slots 43 to produce high pressure hydrogen, as disclosed in the commonly assigned, co-pending U.S. Pat. application Ser. No. 061,214. However, in the preferred embodiment, the high temperature, high pressure plasma discharge in passage 37 initiates an exothermic chemical reaction of the aluminum and water in the slurry in slots 43 and chamber 18 to form hydrogen gas and particulate, as well as liquid forms of the aluminum oxides AlO, $AlO_2$ and $Al_2O_3$; increasing amounts of $Al_2O_3$ form as the plasma temperature decreases. Significant amounts of $Al_2O_3$ are formed only about at the time the discharge between electrodes 33 and 34 is being extinguished.

The water in slots 43 and chamber 18 is transformed by the high temperature plasma into steam, some of which is dissociated into hydrogen and oxygen molecules, while the solid aluminum particles are vaporized and gasified in response to the heat and pressure of the plasma. The chemical reaction, which is dependent upon the plasma temperature, of the steam and aluminum is:

$$3H_2O + 2Al \rightarrow 3H_2 + xAlO + x\,AlO_2 + (1-x)\,Al_2O_3$$

where x increases as temperature increases such that x is about 0.99 for the highest temperature of the plasma in the discharge of passage 37. The multiple plasma jets flowing through slots 43 interact over a large volume throughout the length of chamber 18 with the water aluminum slurry in the chamber to produce large amounts of hydrogen gas primarily in accordance with the stated reaction where $x = 1$. The pressure developed in chamber 18 ruptures capsules 203 to provide greater volume in the chamber and enable the plasma to more easily flow through the slurry.

The high sound speed, high pressure hydrogen initially flows out of chamber 18 against projectile 19 prior to the other gases in chamber 18 reaching the projectile, to enable the high sound speed hydrogen to accelerate the projectile to higher speeds than can be achieved in response to the aluminum oxide vapors and gases. Because the power applied to electrodes 34 and 35 by supply 16 increases linearly with time, the pressure in the barrel bore is approximately constant as projectile 19 is accelerated. In experiments actually performed, the gaseous energy applied to projectile 19 exceeded the electrical energy supplied by power supply 16 to electrodes 33 and 35 by as much as 25 percent, a result possible because of the release of energy by the chemical reactions in chamber 18.

Figure 1C:
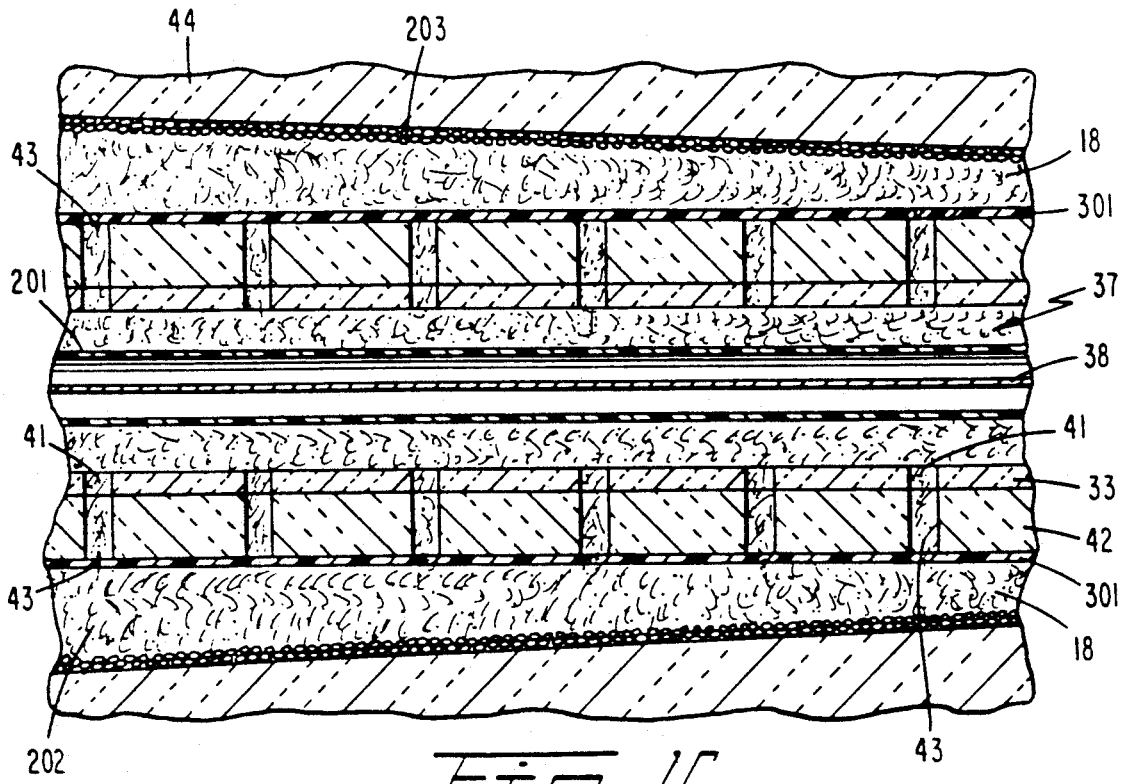
FIG. 1C is a view, similar to that of FIG. 1B, of a second embodiment of the gun.

In a second embodiment of the invention, as illustrated in FIG. 1C, fuel in passage 37 is initially separated from that in chamber 18 by wrapping thin dielectric layer 301, preferably formed of a hydrocarbon, such as polyethylene, around the periphery of sleeve 42. Layer 301, bonded to the periphery of sleeve 42, is consumed by the high temperature plasma to form gaseous hydrogen and carbon atoms. Layer 301 enables fuels of different types to be stored in passage 37 and chamber 18. Preferably these different types of fuels chemically interact with each other when layer 301 is consumed and the fuels contact each other. In one embodiment, the fuel in passage 37 has a much lower viscosity than that in chamber 18, to enable passage 37 to be more readily filled; e.g., the fuel in passage 37 has a very large percentage of water containing a small percentage of aluminum particles while the fuel in chamber 18 is a water-aluminum slurry with a very high percentage of aluminum relative to that of water. In a further embodiment chamber 18 includes an oxidizer, e.g., $H_2O_2$, initially separated by layer 301 from a hydrogen carbon liquid, such as kerosene, that chemically reacts with the oxidizer in response to the plasma generated initially in sleeve 201 and which propagates transversely through passage 37 and slots 43 into chamber 18. Alternatively the oxidizer can react with a hydrocarbon, e.g., parafin, initially in a molded, solid form in passage 37.

Figure 3:
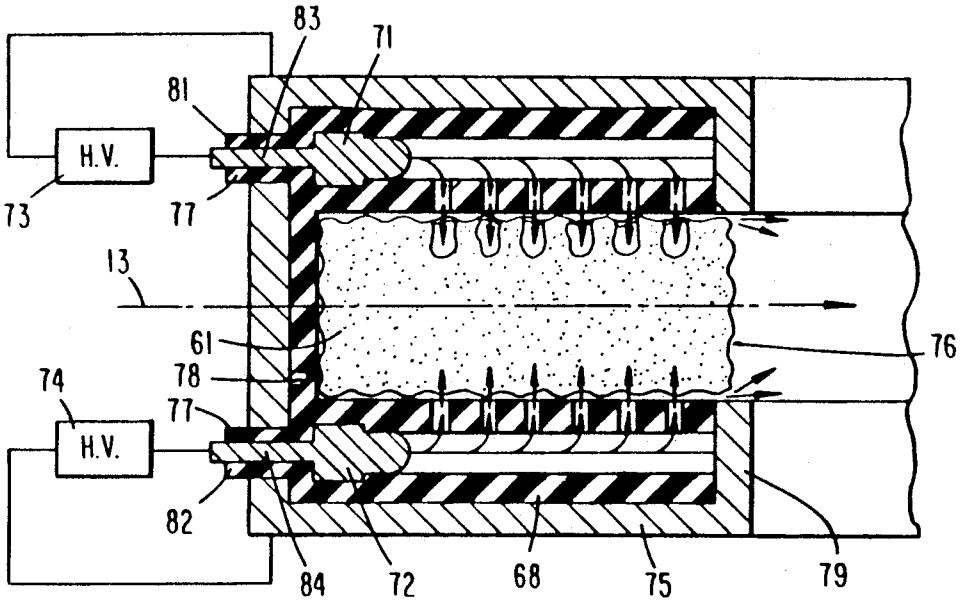
FIG. 3 is a side sectional view of the apparatus illustrated in FIG. 2.
Figure 2:
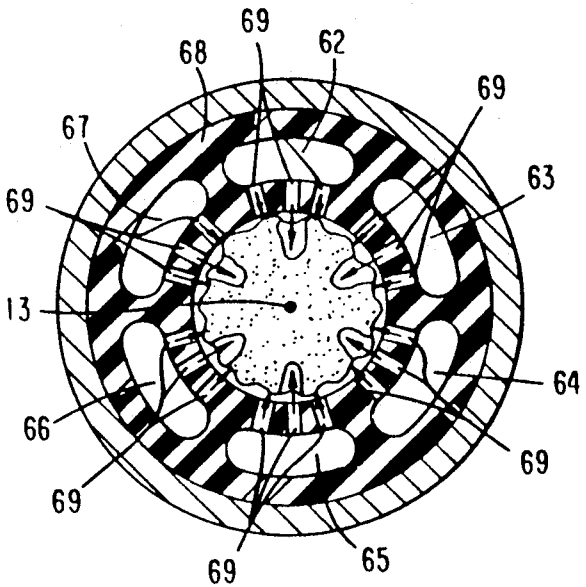
FIG. 2 is a cross sectional view of a further embodiment of the invention wherein plural capillary plasma generating discharge passages supply high temperature, high pressure plasma gas to a chamber.

According to a further embodiment of the invention, as illustrated in FIGS. 2 and 3, greater quantities of high pressure gas are derived and applied to a projectile in a bore of a barrel (not shown) by plural plasma discharges from which high temperature, high pressure plasma gas flows into central chamber 61. Plasma gas radially implodes into central chamber 61 from the plural sources and from the chamber the gas flows longitudinally in the direction of the axis of the barrel bore against the rear of the projectile to accelerate the projectile through the barrel bore. The projectile may include fins positioned in chamber 61, behind the body of the projectile that extends into the barrel bore.

In the particular embodiment of FIGS. 2 and 3, capillary discharge passages 62-67 are equally spaced about the wall of dielectric tube 68, formed of ablatable material having significant amounts of hydrogen and carbon, such as LEXAN. Each of passages 62-67 has a kidney-shaped cross section and is equally spaced from longitudinal axis 13. In one embodiment, the cross sectional area and length of passages 62-67 are such that the usual criterion of a capillary passage is established, i.e., the length to effective diameter of each of the passages is at least 10 to 1.

The plasma developed in each of capillary passages 62-67 flows inwardly through radially directed slots 69 into chamber 61. As illustrated in FIGS. 2 and 3, slots 69 are arranged so that there are several sets of slots along the length of each of the passages and there are plural slots at each longitudinal position; in FIGS. 2 and 3, there are three radially extending slots 69 at each of six longitudinal positions along the length of passages 62-67. Passages 62-67, slots 69 and chamber 61 are preferably substantially filed with a water aluminum slurry so that the same basic mechanism occurs in the embodiment of FIGS. 2 and 3 as in the FIG. 1 embodiment.

At the breech end of each of capillary passages 62-67 there is a separate electrode; in the cross sectional view of FIG. 3, electrodes 71 and 72 are illustrated as being at the breech ends of capillary passages 62 and 65, respectively. Preferably, each of the electrodes at the breech end of passages 62-67 is connected to one terminal of a high voltage power supply having a second terminal connected to metal, cup-like casing 75 which is electrically insulated from the electrodes at the breach end of passages 63-67. Cup 75 forms a common electrode for the ends of capillary discharge passages 62-67 remote from electrodes 71 and 72 since the cup end wall 79 blocks the end of each of the passages. Cup end wall 73 includes circular center opening 76 having a diameter equal to the diameter of chamber 61. Opening 76 forms an orifice to supply the high pressure gas which is developed in chamber 61 to the rear of the projectile to accelerate the projectile along the bore length of barrel 12.

Dielectric tube 68 includes plural longitudinally extending extensions 77 which project through apertures in breech end wall 78 of cup 75 opposite from end wall 79. One extension is provided for each of capillary passages 62-67, so that in the cross sectional view of FIG. 3, extensions 81 and 82 are respectively illustrated in connection with capillary passages 62 and 65. Each of the extensions includes a longitudinally extending bore through which the electrode at the breech end of each capillary passage extends; in FIG. 3, rod-like segments 83 and 84 extend through the bores of dielectric extensions 81 and 82. Rod-like extensions 83 and 84 are connected by suitable buses to one terminal of high voltage power supplies 73 and 74, the other terminals of which are connected by a suitable bus to metal cup 75.

In response to energization of power supplies 73 and 74 a discharge is established between electrodes 71 and 72 through capillary passages 62-67 to the end wall segments of cup 75 closing capillary passages 62 and 65. In response to the discharges, high pressure plasma is simultaneously generated in each of capillary passages 62-67. The high pressure plasma flows radially through slots 69 into chamber 61. The discharge is initiated in passages 62-67 through the use of a consumable electrode, as described supra. The power derived from high voltage source 73 and supplied to all of the capillary passages preferably increases linearly as a function of time, to maintain the pressure in the barrel bore approximately constant as the projectile moves down the barrel.

Figure 4:
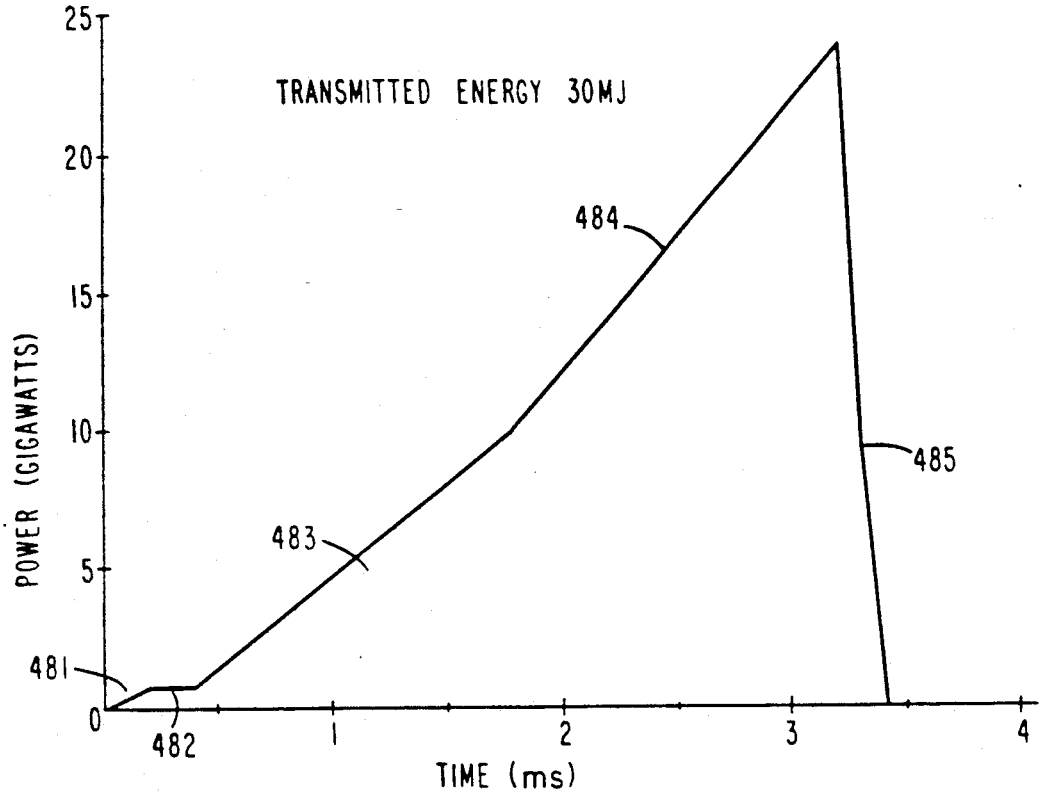
FIG. 4 is a graph indicating the operation of the invention.

In a preferred embodiment, the time variation of the power supplied in parallel by power supplies 73, 74 to capillary passages 62-67 or supplied by plural synchronized power supplies to the six capillary passages is illustrated in FIG. 4, wherein total power, in gigawatts, is plotted against time in milliseconds. Initially, the power supplied to capillary passages 62-67 increases linearly with time for about 0.2 millisecond to a power level of about a half gigawatt, as indicated by waveform segment 481. The power supplied to capillary passages 62-67 is maintained constant at this level until about 0.45 milliseconds has elapsed, as indicated by waveform portion 482. At the conclusion of 0.45 milliseconds, the discharge is established in each of capillary passages 62-66. At this time, the plasma being supplied to chamber 61 has sufficient power to initiate substantial movement of the projectile down the barrel bore.

Shortly after projectile 19 has started to move away from its initial position, the power supplied to capillary passages 62-67 increases linearly as indicated by waveform portion 483, until two milliseconds have elapsed, at which time the total power supplied to the capillary passages is approximately 10 gigawatts. To maintain the pressure applied to projectile 19 substantially constant as the effective length of the barrel bore increases, the slope of the power vs. time curve is increased slightly at 10 milliseconds, as indicated by waveform portion 484, so that after approximately 3.45 milliseconds has elapsed the total power supplied to capillary passages 62-67 is approximately 25 gigawatts. For a typical 120 mm projectile, no further power need be applied to capillary passages 62-67 to achieve a muzzle velocity of about 2.5 km per second. The power supplied to capillary 62-66 suddenly drops virtually to zero, as indicated by waveform portion 485, at the 3.45 millisecond time.

The power variations indicated by waveform portions 81-84 in FIG. 4 are accompanied by increases in the square of the current supplied by the high voltage, high power, power supply while the power supply voltage remains substantially constant. The total energy extracted from the power supply in such a situation is approximately 30 mega-joules. The increased efficiency of the transverse plasma generator over the axial plasma generator as disclosed in the aforementioned prior art can be realized by considering that a power waveform having essentially the same shape as the waveform of FIG. 4, when used with a longitudinal plasma source, can accelerate a 120 mm projectile to a velocity of 2.5 km per second, muzzle velocity only if 40.6 mega-joules is expended from the electric power supply. Hence, the transverse plasma flow system of the present invention achieves about a 25% increase in efficiency over the axial flow plasma generator.

Figure 5:
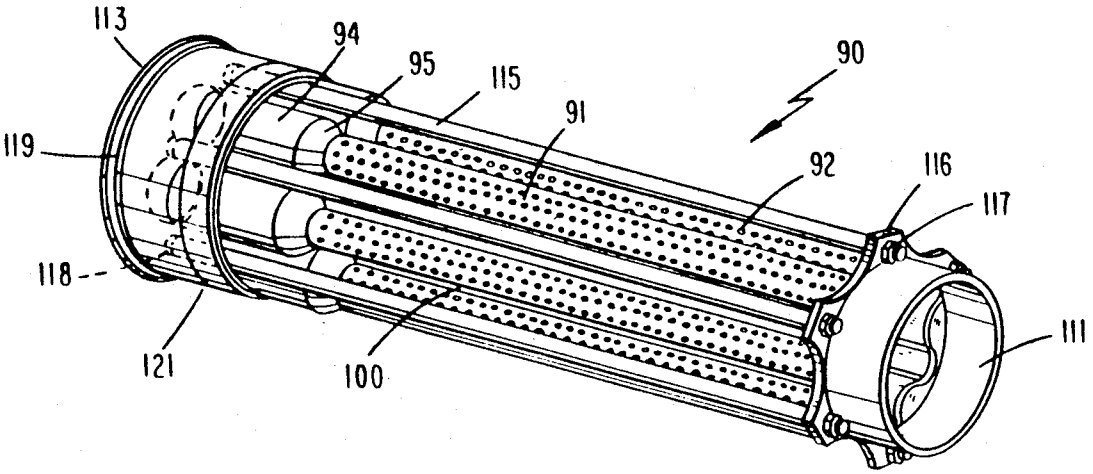
FIG. 5 is a perspective view of another embodiment of the invention, including plural capillary plasma discharges.
Figure 6:
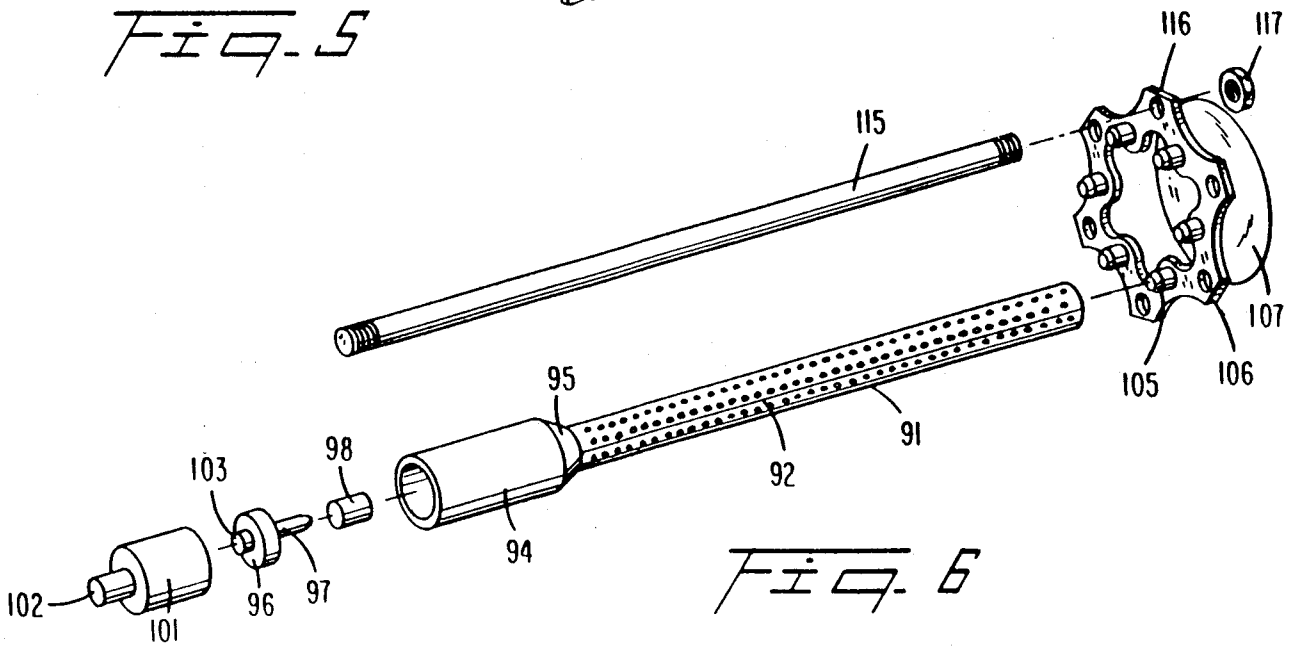
FIG. 6 is an exploded view of a portion of the structure illustrated in FIG. 5.
Figure 7:
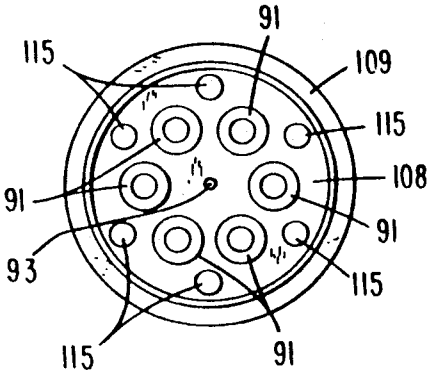
FIG. 7 is a cross-sectional view of the device illustrated in FIGS. 5 and 6.

Reference is now made to FIGS. 5, 6 and 7 of the drawing, respectively a perspective view, a partial exploded view, and a sectional view of a further embodiment of a cartridge including multiple transverse flow plasma generators. High pressure, projectile accelerator 90 of FIGS. 5, 6 and 7 includes six elongated dielectric, preferably LEXAN capillary tubes 91; only three of tubes 91 are illustrated in FIGS. 5 and 6. Orifices 92 extend throughout the length and circumference of each tubes 91 that are equi-angularly disposed about longitudinal axis 93 of the cartridge high pressure cartridge source 90. Tubes 91 are dimensioned so that a capillary plasma discharge occurs therein as described in connection with FIG. 1.

Bonded to the breech end of each of dielectric capillary tubes 91 is a frustro-conical collar 95 that is an integral part of metal tube 94. Metal disk 96, which in combination with tube 94 forms one electrode of the plasma generator, is inserted into tube 94 so that the periphery of the disc engages and is bonded to the inner wall of tube 94. Extending longitudinally from disc 96 is consumable starter electrode 97 which projects through tube 94 into capillary tube 91 to initiate the discharge within the capillary tube. Starter electrode 97 is electrically connected to electrode disc 96 and extends through cylindrical pressure seal 98, having an end face abutting against the face of disc 96 which extends into tube 94. Pressure seal 98 is dimensioned and positioned in tube 94 so that it bears against frustro-conical collar 95 and contacts disc 96 so that the high pressure developed in the capillary passage within tube 92 does not affect the connection of the electrode to an external power supply terminal. The space within tube 94 between the edge of the tube opposite collar 95 and electrode tube 96 is filled with cylindrical insulator 101 which surrounds metal wire 102. Wire 102 extends beyond the opposite, parallel end walls of insulator 101 and is bonded to stub shaft 103 which extends from electrode 96 toward the breech end of a gun including high pressure generator 90. Wire 102 is connected by a suitable bus wire to one terminal of a high voltage supply, of the type discussed supra in connection with FIGS. 1-3. Thereby, one electrode of the high voltage supply is connected via wire 102, stub shaft 103, electrode 96 and tube 94 to the breech end of dielectric tube 91.

The other end of tube 91, adjacent the projectile to be accelerated, fits into metal stub shaft 105 that extends longitudinally from metal, preferably tungsten, electrode plate 106. Electrode plate 106 is bonded or formed integrally with metal tube 107, that is coaxial with axis 93 and extends toward the projectile.

Opposite voltage terminals of a high voltage, high current power supply as discussed supra, are applied to tube 95 and stub shaft 105 to establish the plasma capillary discharge within tube 91. The capillary discharge causes high pressure, high temperature plasma to flow through orifices 92 of each of the six capillary tubes 91. Orifices 92 in tube 91 are small, typically 2 millimeters in diameter. Because there are about 500 orifices 92 in each tube, the combined cross sectional area for the plasma to flow through is many times that of the cross sectional area of the capillary. Therefore, the transverse flow plasma generator of FIGS. 5, 6, and 7 can accommodate a significantly larger power flow than an axial flow plasma generator. At the same time, the many small jets derived by the transverse flow of the present invention are distributed along the length of the capillary and provide a more uniform mixing of the plasma into propellent in chamber 108 having an outer cylindrical wall 109. The high temperature, high pressure plasma flows into chamber 108 surrounding the six capillary passages on all sides.

Preferably, tubes 91, orifices 92 and chamber 108 include the water aluminum slurry discussed supra that exothermically chemically reacts in response to the plasma flowing through orifices 92 to generate high pressure hydrogen. Tubes 91 have a hollow center where the capillary discharge is established; the slurry is spaced from the discharge by a rigid sleeve similar to sleeve 201, FIG. 1B. The high pressure gas developed in chamber 108 is confined by cylindrical wall 109 of the high pressure gas generator and flows out of chamber 108 through passage 111 that extends through plate 106 and tube 107. The high pressure gas flowing through orifice 111 acts against the rear of a projectile (not shown) which is accelerated through a barrel having a longitudinal axis coincident with axis 93. The projectile is positioned in a barrel bore downstream of orifice 111If the projectile includes fins, the fins are preferably positioned in chamber 108. Similarly fins of a projectile can be located in chamber 61, FIG. 3.

The assembly including stub shafts 105, electrode plate 106 and tube 107 is electrically connected through the breech to a bus from one terminal of the power supply and is fixedly spaced and electrically insulated from dielectric stub case 113 into which tubes 94, insulator 101 and wires 102, and the components associated therewith, are loaded. To these ends, six rods 115, having threaded ends, extend between plate 106 and stub case 113. Each of rods 115 includes a metal, electrically conductive core and a dielectric, preferably LEXAN cladding. The metal core extends through holes 116 in metal plate 106 and is mechanically and electrically connected to the plate by metal nut and washer assemblies 117. The other ends of rods 115 extend through plate 118 of stub case 113 and are mechanically connected to the stub case, without establishing electrical connections to the stub case. The metal cores of tubes 115 extend beyond plate 118 of stub case 113 to establish electrical connections to one of the high voltage source terminals. The remaining terminal of the high voltage source is connected to wires 102, as described supra.

Stub case 118 includes tubular sidewall 121, coaxial with longitudinal axis 93. Wall 121 projects from end wall 119 of the stub case for only about half the length of tubes 94. Wires 102 and insulators 101 fit into cavities (not shown) in end wall 119, to hold the insulators and wires in place, as well as to hold the breech ends of tubes 91 and 94 in situ. The outer surface of wall 121 abuts against and is sealed with jacket 109 to assist in forming chamber 108. The entire assembly goes into the breech end of a suitable device, such as a 120 mm cannon from which projectiles are launched in response to the high pressure gas flowing through orifice 111 against the rear of the projectile.

While there have been described and illustrated several specific embodiments of the invention, it will be clear that variations in the details of the embodiments specifically illustrated and described may be made without departing from the true spirit and scope of the invention as defined in the appended claims.

We claim:

1. An electrothermal gun for accelerating a projectile in a bore of a barrel having a longitudinal axis comprising electric means for establishing a plasma discharge in the direction of the longitudinal axis in a structure confining the discharge, means for preventing the axial flow of fluid from the structure to the barrel, the electric means imparting sufficient energy to the plasma discharge to cause the discharge to have sufficient pressure to accelerate the projectile through the barrel bore, means for establishing a chamber wherein high pressure flows to the rear of the projectile while the projectile is in the bore and being accelerated through the bore, and means for establishing a flow path transverse to the bore from where the discharge occurs into the chamber for enabling gas derived in response to the discharge to flow transversely of the bore and the discharge from the structure into the chamber, the transverse flow path being substantially throughout the length of the plasma discharge.

2. The gun of claim 1 wherein the structure includes a tube having a passage with a dielectric wall.

3. The gun of claim 1 wherein the chamber is positioned radially with respect to the discharge.

4. The gun of claim 3 wherein the means for establishing the flow path from the discharge to the chamber includes multiple, radially extending openings in the structure confining the discharge.

5. The gun of claim 4 wherein the openings are positioned in the structure so that the plasma flows from the discharge into the chamber from many different angles relative to a longitudinal axis of the discharge.

6. The gun of claim 1 wherein the chamber includes a mixture comprising metal particles and a hydrogen containing liquid, the mixture interacting with the high pressure plasma to produce a high pressure gas that flows longitudinally of the discharge from the chamber against the rear of the projectile in the bore.

7. The gun of claim 6 wherein the mixture includes materials that react in response to the plasma to produce high pressure hydrogen.

8. The gun of claim 6 wherein the mixture comprises a metal which exothermically reacts with the liquid in response to the high pressure plasma to produce the high pressure hydrogen.

9. The gun of claim 8 wherein the metal comprises aluminum and the liquid comprises water.

10. The gun of claim 1 wherein the chamber and structure are such that the discharge and chamber are coaxial with each other.

11. The gun of claim 10 wherein the discharge is established in a passage of a tube having radially extending apertures through which the plasma flows outwardly into the chamber.

12. The gun of claim 1 further including a power supply for applying a discharge voltage to the plasma discharge, the power of the power supply increasing as a function of time from initial movement of the projectile in the bore to control the pressure in the bore as the projectile is being accelerated.

13. The gun of claim 12 wherein the power supply is arranged so that the power supplied to the plasma discharge increases substantially linearly as a function of time.

14. The gun of claim 1 wherein the means for establishing the plasma discharge includes means for establishing a plurality of plasma discharges, each having a longitudinal axis parallel to the remaining plasma discharges, the means for establishing the plasma flow paths transversely of the discharge being arranged so that plasma flows transversely from each of the discharges into the chamber.

15. The gun of claim 14 wherein the chamber surrounds all of the discharges so that plasma from each of the discharges flows transversely of each discharge into the chamber.

16. The gun of claim 15 wherein a separate structure is provided for each of the plasma discharges, each structure having a discharge passage with a wall containing dielectric material, each of the structures including openings extending transversely of the passage therein, the openings providing a flow path for high pressure plasma in the passage into the chamber.

17. The gun of claim 16 wherein the openings of each of the structures are located at different longitudinal positions along the length of the structure and are arranged such that plasma flows through different ones of the openings at different angles relative to a longitudinal axis of each passage.

18. An electrothermal gun for accelerating a projectile in a bore of a barrel comprising electric means for establishing a plasma discharge in a structure confining the discharge, the pressure of the plasma in the discharge being sufficient to accelerate the projectile in the bore, means for establishing a chamber wherein high pressure gas flows to the rear of the projectile while the projectile is in the bore and being accelerated through the bore, and means for establishing a flow path transverse to the bore and the discharge from the structure into the chamber for enabling gas derived in response to the discharge to flow transversely of the bore and the discharge from the structure into the chamber, wherein the chamber discharge and barrel bore are arranged so that gas in the chamber flows longitudinally relative to the discharge through an outlet of the chamber into the barrel bore, the chamber having a cross-sectional area which varies as a function of distance from the chamber outlet such that the chamber cross-sectional area decreases for increasing distances away from chamber outlet.

19. An electrothermal gun for accelerating a projectile in a bore of a barrel having a longitudinal axis comprising electric means for establishing a plasma discharge in the direction of the longitudinal axis in a structure confining the discharge, the pressure of the plasma in the discharge being sufficient to accelerate the projectile in the bore, means for establishing a chamber wherein high pressure gas flows to the rear of the projectile while the projectile is in the bore and being accelerated through the bore, and means for establishing a flow path transverse to the bore from where the discharge occurs into the chamber for enabling gas derived in response to the discharge to flow transversely of the bore and the discharge from the structure into the chamber, the transverse flow path being substantially through out the length of the plasma discharge, the structure having a passage with a wall of dielectric material, an electrode at each end of the passage, each of the electrodes plugging an end of the passage to prevent the flow of the high pressure plasma through it.

20. The gun of claim 19 wherein the means for establishing the plasma flow path transversely of the discharge includes multiple openings in the structure between the passage and the chamber, said multiple openings being distributed along the length of the structure relative to a longitudinal axis of the passage and at different angles relative to a longitudinal axis of the passage.

21. The gun of claim 20 wherein the openings are equally angularly spaced about the longitudinal axis of the passage.

22. A method of accelerating a projectile in a bore having a longitudinal axis comprising the steps of applying a discharge voltage between a pair of spaced regions to generate a plasma discharge between the regions, the discharge extending in generally the same direction as the bore, the discharge voltage imparting sufficient energy to the plasma discharge to cause the discharge to have sufficient pressure to accelerate the projectile in the bore, confining the flow in the direction of the discharge of the plasma and high pressure gas resulting from the plasma to a volume between the regions, and responding to the high pressure gas resulting from the plasma discharge and flowing transversely from where the discharge occurs and transversely of the bore axis and the discharge through a wall surrounding the plasma discharge to produce a high pressure gas that acts on the rear of the projectile to accelerate the projectile, the gas flowing transversely of the bore axis flowing substantially throughout the distance between the spaced regions, the high pressure gas which accelerates the projectile flowing against the projectile in generally the same direction as the plasma discharge.

23. The method of claim 22 further including the step of interacting the plasma that has flowed transversely of the discharge with a mixture to produce the high pressure gas.

24. The method of claim 23 wherein material in the mixture chemically reacts in response to the plasma to produce hydrogen having sufficient pressure to accelerate the projectile in the bore.

25. The method of claim 24 wherein the mixture material includes a metal, said metal exothermically reacting with a hydrogen containing liquid in the mixture in response to the plasma flowing transversely of the discharge to produce the hydrogen gas which accelerates the projectile.

26. The method of claim 25 further including the step of increasing the power applied to the discharge as the projectile is being accelerated in a bore of a barrel.

27. The method of claim 26 wherein the power applied to the discharge increases substantially linearly as a function of time as the projectile is being accelerated so that substantially constant pressure is maintained in the barrel while the projectile is being accelerated.

28. Apparatus for generating a high pressure gas having a flow direction along a longitudinal axis comprising electric means for establishing a high pressure plasma discharge between a pair of spaced regions, the discharge extending in generally the same direction as the longitudinal axis and being in a structure having a wall extending between the spaced regions, both ends of the wall being plugged to prevent the flow of plasma in the discharge through them, means for forming a chamber, and means for establishing a fluid flow path transversely to the discharge and transversely from where the discharge occurs to the chamber and through the wall substantially throughout the distance between the spaced regions for enabling high pressure gas resulting from the plasma in the discharge to flow from the structure into the chamber substantially throughout the distance between the spaced regions, and orifice means in the chamber for causing the high pressure gas resulting from the plasma to flow along the longitudinal axis.

29. The apparatus of claim 28 wherein the chamber is positioned radially with respect to the discharge.

30. The apparatus of claim 28 wherein the means for establishing the flow path from the discharge to the chamber includes multiple, radially extending openings in the structure.

31. The apparatus of claim 30 wherein the openings are positioned in the structure so that the plasma flows from the discharge into the chamber from many different angles relative to a longitudinal axis of the discharge.

32. The apparatus of claim 28 wherein the chamber and an outlet of the chamber are arranged so that gas in the chamber flows longitudinally with the discharge through the orifice means of the chamber, the chamber having a cross-sectional area which varies as a function of distance from the chamber outlet such that the chamber cross-sectional area decreases for increasing distances away from said chamber outlet.

33. The apparatus of claim 28 further including a power supply for applying a discharge voltage to the plasma discharge, the power of the power supply applied to the plasma discharge increasing as a function of time to control pressure in a confined passage downstream of an outlet of the chamber.

34. The apparatus of claims 28 wherein a plurality of said structures is included, each of the structures including means for providing multiple flow paths at different longitudinal positions along the length of the structure, the flow paths being arranged such that plasma flows through different ones of the multiple flow paths at different angles relative to a longitudinal axis of each passage.

35. Apparatus for generating a high pressure gas having a flow direction along a longitudinal axis comprising electric means for establishing a high pressure plasma discharge between a pair of spaced regions, the discharge extending in generally the same direction as the longitudinal axis and being in a structure having a wall extending between the spaced regions, both ends of the wall being plugged to prevent the flow of plasma in the discharge through them, means for forming a chamber, and means for establishing a fluid flow path from the discharge to the chamber transversely to the discharge and through the wall substantially throughout the distance between the spaced regions for enabling high pressure gas resulting from the plasma in the discharge to flow from the structure into the chamber substantially throughout the distance between the spaced regions, and orifice means in the chamber for causing the high pressure gas resulting from the plasma to flow along the longitudinal axis, the chamber and the plasma discharge being included in structures such that the discharge and chamber are coaxial with each other.

36. The apparatus of claim 35 wherein the chamber includes a material that interacts with the high pressure plasma to produce a high pressure gas.

37. The apparatus of claim 36 wherein the material is of a type that reacts in response to the plasma to produce high pressure hydrogen.

38. The apparatus of claim 37 wherein the material in the chamber comprises a metal and hydrogen containing fluid which chemically react in response to the high pressure plasma to produce the high pressure hydrogen.

39. The apparatus of claim 35 wherein the discharge is established in a passage of a tube having radially extending apertures through which the plasma flows outwardly into the chamber.

40. Apparatus for generating a high pressure gas having a flow direction along a longitudinal axis comprising electric means for establishing a high pressure plasma discharge between a pair of spaced regions, the electric means imparting sufficient energy to the plasma discharge to cause the discharge to have sufficient pressure to accelerate the projectile through the barrel bore, the discharge extending in generally the same direction as the longitudinal axis and being in a structure having a wall, means for forming a chamber, and means for establishing a fluid flow path from the discharge to the chamber transversely to the discharge and through the wall substantially throughout the distance between the spaced regions for enabling high pressure gas resulting from the plasma in the discharge to flow from the structure into the chamber substantially throughout the distance between the spaced regions, and orifice means in the chamber for causing the high pressure gas resulting from the plasma to flow along the longitudinal axis, the means for establishing the plasma discharge including means for establishing a plurality of plasma discharges, each having a longitudinal axis parallel to the remaining plasma discharges, the means for establishing the plasma flow path transversely of the discharge being arranged so that plasma flows transversely from each of the discharges into the chamber, and means for plugging ends of volumes where the discharges occur to prevent the flow of the plasma through the regions.

41. The apparatus of claim 40 wherein the chamber surrounds all of the discharges so that plasma from each of the discharges flows transversely of each discharge into the chamber.

42. The apparatus of claim 40 wherein each of the structures includes means for providing multiple flow paths at different longitudinal positions along the length of the structure, the multiple flow paths being arranged such that plasma flows through different ones of the multiple flow paths at different angles relative to a longitudinal axis of each passage.

43. Apparatus for generating a high pressure gas comprising electric means for establishing a high pressure plasma discharge between a pair of spaced regions, the discharge being in a structure having a wall, means for forming a chamber, and means for establishing a fluid flow path from the discharge to the chamber transversely to the discharge and through openings in the wall for enabling high pressure gas resulting from the plasma in the discharge to flow from the structure into the chamber, the structure including a passage having a wall of dielectric material, an electrode at each end of the passage, each of the electrodes plugging an end of the passage to prevent the flow of the high pressure plasma through it.

44. The apparatus of claim 43 wherein the means for establishing the plasma flow path transversely of the discharging includes means for providing multiple separate flow paths in the structure between the passage and the chamber, said multiple flow paths being distributed along the length of the structure relative to a longitudinal axis of the passage and at different angles relative to a longitudinal axis of the passage.

45. The apparatus of claim 44 wherein the multiple flow paths are equi-angularly spaced about the longitudinal axis of the passage.

46. An electrothermal gun for accelerating a projectile in a bore of a barrel comprising electric means for establishing a plasma discharge in a volume between a pair of spaced regions having plugs therein for preventing the flow of plasma in the discharge through ends of the regions, the electric means imparting sufficient energy to the plasma discharge to cause the discharge to have sufficient pressure to accelerate the projectile through the barrel bore, means for establishing a chamber from which high pressure gas flows to the rear of the projectile while the projectile is in the bore and being accelerated through the bore, and means for establishing a fluid flow path from the discharge into the chamber for enabling plasma in the discharge to flow from the discharge into the chamber, the means for establishing the discharge including a tube having a passage with a dielectric wall, the passage including a mixture comprising metal particles and a hydrogen containing liquid, the mixture being initially spaced from and responding to the discharge to produce a chemical reaction from which high pressure hydrogen gas is produced, the hydrogen gas having sufficient pressure to accelerate the projectile through the bore.

47. The gun of claim 46 further including first and second spaced electrodes at opposite ends of the discharge, a starter means consumed in response to current flowing through it extending in a direction between the spaced electrodes for initiating a plasma discharge between the electrodes, a dielectric sleeve surrounding the starter means for preventing the mixture from being in a region where a discharge is initially established between the electrodes, said dielectric sleeve confining a dielectric fluid having a low thermal capacity relative to that of the mixture so that plasma in the fluid derived in response to the initial discharge develops sufficient heat to form a plasma in the mixture.

48. The gun of claim 46 wherein the chamber includes a mixture of said metal particles and said hydrogen containing liquid.

49. An electrothermal gun for accelerating a projectile in a bore of a barrel comprising electric means for establishing a plasma discharge along a longitudinal axis of a volume, means for plugging ends of the volume to prevent the flow of plasma in the discharge through the ends, the electric means imparting sufficient energy to the plasma discharge to cause the discharge to have sufficient pressure to accelerate the projectile through the barrel bore, means for establishing a chamber wherein high pressure gas flows to the rear of the projectile while the projectile is in the bore and being accelerated through the bore, and means for establishing a flow path transversely of the axis from the discharge into the chamber for enabling plasma in the discharge flow from the discharge into the chamber, the chamber including a slurry of aluminum particles and water that exothermically react in response to the plasma flowing into the chamber to produce hydrogen gas and oxides of aluminum, the hydrogen gas having sufficient pressure to accelerate the projectile through the bore.

50. A method accelerating a projectile in a bore comprising the steps of applying a discharge voltage between a pair of spaced regions to generate a plasma discharge between the regions, the discharge voltage imparting sufficient energy to the plasma discharge to cause the discharge to have sufficient pressure to accelerate the projectile in the bore, preventing the flow of the plasma longitudinally through ends of the spaced regions, and chemically reacting high pressure gas resulting from the plasma discharge and flowing transversely from the discharge throughout a substantial distance between the spaced regions with a mixture to produce a high pressure gas that acts on the rear of the projectile to accelerate the projectile, the high pressure gas which accelerates the projectile flowing against the projectile in generally the same direction as the plasma discharge.

51. The method of claim 50 wherein material in the mixture chemically reacts in response to the plasma to produce hydrogen having sufficient pressure to accelerate the projectile in the bore.

52. The method of claim 51 wherein the mixture material includes a metal, said metal exothermically reacting with a hydrogen containing liquid in the mixture in response to the plasma flowing transversely of the discharge to produce the hydrogen gas which accelerates the projectile.

53. The method of claim 52 further including the step of increasing the power applied to the discharge as the projectile in being accelerated in a bore of a barrel.

54. An electrothermal gun for accelerating a projectile in a bore of a barrel, the bore and barrel having a longitudinal axis, comprising means including an electric power supply for establishing a plasma discharge, the power supply imparting sufficient energy to the plasma discharge to cause the discharge to have sufficient pressure to accelerate the projectile through the barrel bore, means for establishing a chamber wherein high pressure gas flows to the rear of the projectile while the projectile is in the bore and being accelerated through the bore, and means for establishing a flow path for the plasma in the discharge from the discharge into the chamber transversely to the bore longitudinal axis, the flow path being transverse from a region where the discharge occurs through a substantial length of the discharge, and means for plugging ends of the region at right angles to the discharge to prevent the axial flow of the plasma through the ends of the region, the chamber including a material that interacts with the plasma flowing into the chamber from the discharge to produce the high pressure gas that flows to the rear of the projectile to accelerate the projectile in the bore.

55. The electrothermal gun of claim 54 wherein the material in the chamber includes a mixture of metal particles and a hydrogen containing liquid, the mixture interacting with the plasma to produce a chemical reaction resulting in the production of hydrogen gas, the hydrogen gas being the high temperature gas that accelerates the projectile in the bore.

56. A method of accelerating a projectile in a bore of a gun barrel, the bore and barrel having a longitudinal axis, comprising establishing a plasma discharge, connecting an electric power supply to a volume where the discharge is established, the power supply imparting sufficient energy to the plasma discharge to cause the discharge to have sufficient pressure to accelerate the projectile through the barrel bore, flowing plasma resulting from the discharge transversely to the bore longitudinal axis into a chamber, the flow path being transverse from a region where the discharge occurs through a substantial length of the discharge, preventing the plasma from flowing through ends of the region, applying the plasma flowing into the chamber to material in the chamber to instigate a chemical reaction between components of the material, the chemical reaction producing a gas having sufficiently high pressure to accelerate the projectile in the bore, and flowing the high pressure gas longitudinally of the bore from the chamber into the bore against the projectile to accelerate the projectile in the bore.

57. An electrothermal gun for accelerating a projectile along a longitudinal axis of a bore of a barrel of the gun comprising means including an electric power supply for establishing a plasma discharge, the power supply imparting sufficient energy to the plasma discharge to cause the discharge to have sufficient pressure to accelerate the projectile through the barrel bore, a chamber, means for providing a flow path for plasma produced by the discharge from the discharge to the chamber, the flow path being transverse to the bore longitudinal axis, the flow path being transverse from a region where the discharge occurs through a substantial length of the discharge, means for plugging ends of the region where the discharge occurs to prevent the plasma from flowing through the ends of the region, the chamber including a mixture of components that react chemically in response to the plasma flowing via the path being incident thereon, a product of the chemical reaction being a gas having sufficiently high pressure to accelerate the projectile, and means for providing a flow path for the gas longitudinally of the bore from the chamber into the bore against the projectile to accelerate the projectile in the bore.

58. Apparatus for providing a flow of a high pressure gas along a longitudinal axis comprising means including an electric power supply for establishing a plasma discharge, the power supply imparting sufficient energy to the plasma discharge to cause the discharge to have sufficient pressure to accelerate the projectile through the barrel bore, a chamber, means for providing a flow path for plasma produced by the discharge from the discharge to the chamber, the flow path being transverse to the longitudinal axis, the flow path being transverse from a region where the discharge occurs through a substantial length of the discharge, means for plugging ends of the region where the discharge occurs to prevent the plasma from flowing through the ends of the region, the chamber including a mixture of components that react chemically in response to the plasma flowing via the path being incident thereon, a product of the chemical reaction being the high pressure gas, the chamber including orifice means with an outlet for directing the flow of the high pressure gas in the direction of the longitudinal axis.

59. The apparatus of claim 58 wherein the means for providing the flow path includes materials that react chemically in response to the plasma being incident thereon, said materials chemically reacting to produce high pressure gas that flows with the plasma via the flow path to the chamber.

60. The apparatus of claim 59 wherein said materials and said mixture of components are the same.

61. The apparatus of claim 59 further including means for initially separating said materials from said components, said separating means being consumed by said plasma so that said materials and said components int he mixture interact with each other in response to the plasma being incident thereon.

62. The apparatus of claim 61 wherein the initially separated materials and components are different types of fuels that chemically react with each other in response to the separating means being consumed to cause the fuels to contact each other.

63. The apparatus of claim 62 wherein the fuel in the flow path providing means has a viscosity substantially lower than that in the chamber.

64. Apparatus for providing a flow of high pressure gas along a longitudinal axis comprising means including an electric power supply for establishing a plasma discharge, the power supply imparting sufficient energy to the plasma discharge to cause the discharge to have sufficient pressure to accelerate the projectile through the barrel bore, a chamber, means for providing a flow path for plasma produced by the discharge from the discharge to the chamber, the flow path being transverse to the longitudinal axis, the flow path being transverse from a region where the discharge occurs through a substantial length of the discharge, the chamber including a mixture of components that react chemically in response to the plasma flowing via the path being incident thereon, a product of the chemical reaction being the high pressure gas, the chamber including orifice means with an outlet for directing the flow of the high pressure gas in the direction of the longitudinal axis, means for providing the flow path including material that react chemically in response to the plasma being incident thereon, said materials chemically reacting to produce high pressure gas that flows with the plasma via the flow path to the chamber, means for initially separating said materials from said components, said separating means being consumed by said plasma so that said materials and said components in the mixture interact with each other in response to the plasma being incident thereon, the initially separated materials and components being different types of fuels that chemically react with each other in response to the separating means being consumed to cause the fuels to contact each other, the fuel in the flow path providing means having a viscosity substantially lower than that in the chamber, the fuel in the flow path providing means having a very large percentage of water containing a small percentage of aluminum particles and the fuel in the chamber being a slurry with a very large percentage of aluminum relative to the percentage of water.

65. Apparatus for accelerating a projectile in a bore having an elongated axis comprising a plasma source including a pair of electrodes longitudinally spaced from each other in a region so a longitudinal axis between the electrodes extends in the same direction as the elongated axis of the bore, means for connecting said electrodes to opposite terminals of a power supply to establish an electric discharge between the electrodes, the electric discharge establishing a plasma between the electrodes and imparting sufficient energy to the plasma to cause the plasma to have sufficient energy to accelerate the projectile in the bore, a chamber in fluid flow relation with the region the chamber and region being positioned so that fluid including the plasma flows radially from between the electrodes into the chamber, said chamber including a mass of material positioned, arranged and of a type that is energized in response to the plasma being incident thereon to produce a low atomic weight gas, means for preventing the axial flow of fluid from the region to the bore, and means for establishing a flow path for the low atomic weight gas from the chamber into the bore in a direction extending in generally the same direction as the elongated axis.

66. The apparatus of claim 65 wherein the gas includes hydrogen.

67. The apparatus of claim 66 wherein the mass includes components that are heated by the plasma to a sufficient temperature to produce a chemical reaction to produce the hydrogen gas.

68. The apparatus of claim 67 wherein the components include water and a metal.

69. The apparatus of claim 65 wherein the chamber and region are concentric.

70. The apparatus of claim 69 wherein the chamber surrounds the region.

71. The apparatus of claim 65 wherein a plurality of said regions are provided so that each region includes a pair of longitudinally spaced electrodes, a radial flow being provided from between the electrodes of each of said regions into said chamber.

72. The apparatus of claim 71 wherein the radial flow is directed inwardly toward a longitudinal axis of the chamber, the regions having longitudinal axes extending in the same direction as the chamber longitudinal axis.

73. The apparatus of claim 71 wherein the radial flow is directed outwardly away from a longitudinal axis of the chamber, the regions having longitudinal axes extending in the same direction as the chamber longitudinal axis.

74. The apparatus of claim 71 wherein the radial flow is directed inwardly toward and outwardly away from a longitudinal axis of the chamber, the regions having longitudinal axes extending in the same direction as the chamber longitudinal axis.

75. A method of accelerating a projectile in a bore having an elongated axis comprising establishing a plasma discharge by providing a discharge voltage between a pair of spaced electrodes in a region having a longitudinal axis extending in the same direction as the elongated axis the discharge voltage imparting sufficient energy to the plasma to enable the plasma to accelerate the projectile in the bore, preventing the axial flow of fluid from the region to the bore, flowing fluid including the plasma radially from the region between the electrodes into a chamber, generating a low atomic weigh gas in the chamber by causing the radially flowing plasma to be incident on a mass of material in the chamber, and flowing the generated low atomic weight gas from the chamber longitudinally of the elongated axis into the bore so the projectile is accelerated in the bore.

76. The method of claim 75 wherein the gas includes hydrogen.

77. The method of claim 76 wherein the mass includes components that are heated by the plasma to a sufficient temperature to produce a chemical reaction to produce the hydrogen gas.

78. The method of claim 76 wherein the components include water and a metal.

79. The method of claim 75 wherein the radial flow is directed outwardly from the region into the chamber.

80. The method of claim 75 wherein the radial flow is directed inwardly and outwardly from the region into the chamber.

81. The method of claim 75 wherein the radial flow is directed inwardly from the region into the chamber.

82. An electrothermal gun for accelerating a projectile in a bore of a barrel having a longitudinal axis comprising electric means for establishing a plasma discharge in the direction of the longitudinal axis in a structure confining the discharge, the pressure of the plasma int he discharge being sufficient to accelerate the projectile in the bore, means for establishing a chamber wherein high pressure gas flows to the rear of the projectile while the projectile is in the bore and being accelerated through the bore, and means for establishing a flow path transverse to the bore from where the discharge occurs into the chamber for enabling gas derived in response to the discharge to flow transversely of the bore and the discharge from the structure into the chamber, the transverse flow path being substantially throughout the length of the plasma discharge, the structure having a passage in which the discharge is established, each end of the passage being plugged to prevent the flow of the high pressure plasma through it.

83. Apparatus for generating a high pressure gas having a flow direction along a longitudinal axis comprising electric means for establishing a high pressure plasma discharge between a pair of spaced regions, the discharge extending in generally the same direction as the longitudinal axis and being in a structure having a wall, means for forming a chamber, and means for establishing a fluid flow path transversely to the discharge and transversely from where the discharge occurs to the chamber and through the wall substantially throughout the distance between the spaced regions for enabling high pressure gas resulting from the plasma in the discharge to flow from the structure into the chamber substantially throughout the distance between the spaced regions, and orifice means in the chamber for causing the high pressure gas resulting from the plasma to flow along the longitudinal axis, the structure having a passage in which the discharge is established, each end of the passage having an end face for preventing the flow of the high pressure plasma through it.

84. An electrothermal gun for accelerating a projectile in a bore of a barrel comprising electric means for establishing a plasma discharge between a pair of spaced regions, means for establishing a chamber from which high pressure gas flows to the rear of the projectile while the projectile is in the bore and being accelerate through the bore, and means for establishing a fluid flow path from the discharge into the chamber for enabling plasma in the discharge to flow from the discharge into the chamber, the means for establishing the discharge including a tube having a passage with a dielectric wall, the passage including a mixture comprising metal particles and a hydrogen containing liquid, the mixture being initially spaced from and responding to the discharge to produce a chemical reaction from which high pressure hydrogen gas is produced, the hydrogen gas having sufficient pressure to accelerate the projectile through the bore, each end of the passage being plugged to prevent the flow of the plasma through it.

85. A method of accelerating a projectile in a bore having a longitudinal axis comprising the steps of applying a discharge voltage between a pair of spaced regions to generate a plasma discharge between the regions, the discharge extending in generally the same direction as the bore, the plasma discharge having sufficient pressure to accelerate the projectile in the bore, and responding to high pressure gas resulting from the plasma discharge and flowing transversely from where the discharge occurs and transversely of the bore axis and the discharge through a wall surrounding the plasma discharge to produce a high pressure gas that acts on the rear of the projectile to accelerate the projectile, the gas flowing transversely of the bore axis flowing substantially throughout the distance between the spaced regions, the high pressure gas which accelerates the projectile flowing against the projectile in generally the same direction as the plasma discharge, and confining the flow of fluid axially of the discharge to a volume between the regions while the high pressure gas flows against the projectile to accelerate the projectile.

86. A method of accelerating a projectile in a bore comprising the steps of applying a discharge voltage between a pair of spaced regions to generate a plasma discharge between the regions, the plasma discharge having sufficient pressure to accelerate the projectile in the bore, and chemically reacting high pressure gas resulting from the plasma discharge and flowing transversely from the discharge throughout a substantial distance between the spaced regions with a mixture to produce a high pressure gas that acts on the rear of the projectile to accelerate the projectile, the high pressure gas which accelerates the projectile flowing against the projectile in generally the same direction as the plasma discharge, and confining the flow of fluid axially of the discharge to a volume between the regions while the high pressure gas flows against the projectile to accelerate the projectile.

* * * * *